US006695796B1

(12) United States Patent
Solmor

(10) Patent No.: US 6,695,796 B1
(45) Date of Patent: Feb. 24, 2004

(54) CHIROPRACTIC MASSAGE DEVICE

(76) Inventor: David Solmor, 1747 Coral Ridge Dr., Coral Springs, FL (US) 33071

( * ) Notice: Subject to any disclaimer, the term of this patent is extended or adjusted under 35 U.S.C. 154(b) by 143 days.

(21) Appl. No.: 10/091,235

(22) Filed: Mar. 5, 2002

(51) Int. Cl.[7] ..... A61H 1/02; A61G 7/07

(52) U.S. Cl. ..... 601/5; 601/25; 601/26; 601/39; 128/845; 606/237; 606/240

(58) Field of Search ..... 601/5, 23, 24, 601/25, 26, 39; 128/845; 606/237, 240, 244

(56) References Cited

U.S. PATENT DOCUMENTS

| | | | | |
|---|---|---|---|---|
| 3,521,622 A | * | 7/1970 | Collins, Jr. | 601/25 |
| 3,769,636 A | * | 11/1973 | Friedman | 601/23 |
| 5,010,898 A | * | 4/1991 | de Kanawati et al. | 128/845 |
| 5,116,359 A | * | 5/1992 | Moore | 606/241 |
| 5,263,494 A | * | 11/1993 | Margelos et al. | 128/845 |
| 5,569,175 A | * | 10/1996 | Chitwood | 128/845 |
| 6,155,994 A | * | 12/2000 | Hubbard et al. | 601/5 |
| 6,551,214 B1 | * | 4/2003 | Taimela | 601/25 |
| 6,599,257 B2 | * | 7/2003 | Al-Obaidi et al. | 601/5 |

FOREIGN PATENT DOCUMENTS

| | | | |
|---|---|---|---|
| DE | 4328335 | * | 2/1995 |

* cited by examiner

*Primary Examiner*—Danton D. DeMille
(74) *Attorney, Agent, or Firm*—Michael I. Knoll

(57) ABSTRACT

The present invention 10 discloses a device that stimulates and provides chiropractic therapy to the neck and head area of the body. Using a hand-held remote control 68, the doctor or patient 12 utilizes a toggle stick 64 to perform single directional movement of the head 14 in a forward, backward, or side to side motion, or in a clockwise or counter clockwise rotational motion. The head cushion 16 includes a vibration and heating element 58 that is applied to the neck area that can be used alone or in conjunction with the directional and rotational movement. The present invention 10 cradles the head 14 within a cushion 16 that is adjustable vertically and laterally to optimize the positioning of the head and allow for comfort. The vibrating and heating element 58 is isolated from the rest of the head cushion 16 to eliminate transmission of vibrations or heat. The head cushion 16 is supported by an adjustable tripod 28 and controlled by an electric motor that provides motion 46 to a spherical gudgeon 34 and socket 36. In turn, the spherical gudgeon 34 and socket 36 allows for the lateral and rotational movement of the head cushion 16.

16 Claims, 13 Drawing Sheets

CHIROPRACTIC MASSAGE DEVICE

BACKGROUND OF THE INVENTION

1. Field of the Invention

The present invention relates generally to chiropractic massage and more specifically, to a self-fulfilling, upper body chiropractic massage apparatus. The invention relates to a device that stimulates and provides chiropractic therapy to the neck and head area of the body. When in use the present invention allows for lateral and rotational movement of the head and neck muscles. Using a hand held remote control the doctor or patient utilizes a toggle stick to perform single directional movement of the head in a foreword, backward, or side to side motion, or in a clockwise or counter clockwise rotational motion. The head cushion includes a vibration and heating element that is applied to the neck area that can be used in conjunction with the directional and rotational movement, or can be applied alone when the apparatus is stationary. The present invention cradles the head with a cushion housing that is adjustable vertically and laterally to optimize the positioning of the head and allow for comfort. The vibrating and heating element is isolated from the rest of the head cushion to eliminate transmission of such. The head cushion is supported by an adjustable tripod and controlled by an electric motor that provides motion to a spherical gudgeon and socket. In turn the spherical gudgeon and socket allows for the lateral and rotational movement of the head cushion.

2. Description of the Prior Art

There are other massage devices designed for therapeutic massage. Typical of these is U.S. Pat. No. 1,354,865 issued to, Courtney P. Winteron Oct. 5, 1920.

Another patent was issued to Harry C Weaver on Aug. 27, 1928 as U.S. Pat. No. 2,015,298. Yet another U.S. Pat. No. 2,048,712 was issued to Adolf P. C. Schramm on Jun. 20, 1933 and still yet another was issued to O. T. Buffalow on Oct. 3, 1935 as U.S. Pat. No. 2,122,556.

Another patent was issued to Kasuke Sugimoto on May 7, 1958 as U.S. Pat. No. 3,001,523. Yet another U.S. Pat. No. 3,374,784 was issued to Brent G. T. et al on Jan. 7, 1966. Another was issued to Howard W Gouge on Mar. 8, 1982 as U.S. Pat. No. 4,432,113 and still yet another was issued on Jun. 4, 1990 to Martin L Kempler as U.S. Pat. No. 5,097, 823. A patent was issued on Sep. 10, 1993 to James W Campbell as U.S. Pat. No. 5,415,621 and on Jun. 16, 1997 U.S. Pat. No. 5,807,288 was issued to Dong-Her Wu.

Another patent was issued to Matt J. Wollman on Sep. 22, 1995 as U.S. Pat. No. 5,925,002. Yet another U.S. Pat. No. 6,071,252 was issued to Egidio Marcantoni on Sep. 28, 1998.

U.S. Pat. No. 1,354,865

Inventor: Courtney P. Winter

Issues: Oct. 5, 1920

The invention relates in general to movement cure appliances, and particularly to an appliance which may be used as an abdominal massage to simulate the action of the large intestine or colon.

As heretofore practiced, appliances of this kind have generally involved a more or less complicated arrangement of parts, which not only incur considerable expense in manufacture but also, by means of their multiplicity of parts, make it necessary for the user to employ inconvenient methods in deriving the benefits of the appliance.

U.S. Pat. No. 2,015,298

Inventor: Harry C. Weaver

Issues: Aug. 27, 1928

It is an object to provide a machine which will impart to an engaging member adapted to contact a portion of the anatomy of an individual reciprocating motion through a short distance.

Because of the great tension exercised on the engaging member or belt it is necessary to provide an actuating mechanism which is extremely rugged in construction.

U.S. Pat. No. 2,048,712

Inventor: Adolf P. C. Schramm

Issues: Jun. 20, 1993

An electric vibrator apparatus such is adapted for massage purposes, although the features of the improvement would be available for other practical purposes such as treatment or mixing liquids, or use in the laboratory or otherwise for grinding, cutting, polishing, or other treatments or solids, such as a vibratory razor.

The general object of the invention is to provide an electric vibrator operated by a motor of the type having an oscillating shaft, permitting a simple construction in that a plain iron armature without winding may be employed, with a restoring spring opposing the field magnet. Such a motor may be synchronous with the frequency of current alteration, as 60 cycles per second, the vibrator delivering an oscillating movement which is powerful although scarcely perceptible to the eye.

U.S. Pat. No. 2,122,556

Inventor: O. T. Buffalow

Issues: Oct. 3, 1935

This invention relates to a vibrating massager, and aims to provide a novel construction of massaging arm having a ball or roller means to more efficiently move over and massage the spinal tissues and the feet, although capable of use generally.

It further aims to provide a removable element between the balls, for massaging purposes, preferably projecting slightly beyond the balls.

U.S. Pat. No. 3,001,523

Inventor: Kasuke Sugimoto

Issues: May 7, 1958

An apparatus for the correction of displaced spondyls. It is an important object of this invention to provide an improved apparatus for correcting displaced spondyls of the spinal column without causing irritation of the nerves of the spinal cord or of the muscles adjacent thereto.

In accordance with this invention there is provided an apparatus comprising a pair of semi cylindrical members, preferably made of rubber, which are adapted to apply functional rolling contact on the spondyls and to the back of the patient in the vicinity of the spondyls whereby there are imparted to said spondyls effective extending and contracting actions in a direction longitudinally of the spinal column.

U.S. Pat. No. 3,374,784

Inventor: G. T. Brent et al

Issues: Jan. 7, 1966

An apparatus relating to a mechanical massager for both general and localized or concentrated massaging of various areas of the human body which usually is done by the hand, and includes a mechanical massager capable of pressing, kneading, stroking, and other such motions ordinarily done by the hand. It is an object of this invention to provide a simple, inexpensive practical mechanical massager capable of use in the home, office, automobile, or wherever needed to relieve tensions, muscular spasms, fatigue and the like, and installable in existing objects, such as chairs, tables, pillows, beds and the like when there is need for the motions imparted by the hand of a trained technician thereby to provide a beneficial therapeutic effect.

U.S. Pat. No. 4,432,113

Inventor: Howard W. Gouge

Issues: Mar. 8, 1982

An apparatus for providing automatic back washing for a user is disclosed. The back washer of this invention includes a housing which contains an electrical drive source such as a motor, gearing means and a switching means. According to a preferred embodiment, insulated extension member is provided for activating the switch while the back washer is in operation. The gearing means drives a detachable mounting member to which there is attached padding and a cover, respectively. In the preferred embodiment, power shaft is driven by gearing means and includes ridges and grooves to provide a spline which in turn cooperates with a sleeve. According to the preferred embodiment the apparatus is portable and sets on a bathroom counter.

U.S. Pat. No. 5,097,823

Inventor: Martin L Kempler

Issues: Jun. 4, 1990

A device to physically massage a person, the subject lying in a horizontal position and the massaging device positioned over the subject. The massager is comprised of an outer cage in the form of a rectangular cubed structure and an inner carriage in the form of a square frame which is positioned within the cage. The inner carriage, fitted with and mounted on bearings, traverses horizontally toward and away from patient, on guiding tracks, tracks being rigidly mounted in outer cage, this movement being provided by a motor driven crank. The above mentioned carriage assembly houses four horizontally-mounted elongated arms, which are rectangular in form, extending out beyond the cage's perimeter and which are raised vertically by a motor driven crankshaft, then dropped by gravity on patient. A spring-assisted adjustable device is incorporated to affect the intensity of the arm drop weight on a patient. The above described massaging apparatus is mounted on an upright cylindrical pipe structure to facilitate its movement in a horizontal oscillating motion by a motor-mounted crank arm.

U.S. Pat. No. 5,415,621

Inventor: James W. Campbell

Issues: Sep. 10, 1993

A device that simulates massage of various parts of the human body by a human hand as closely as possible. The device involves providing two concentric planes, one created by the rotation of a main shaft, at its projection point of intersection with the applicator head, and the second the plane created by the exposed surface of the applicator head. The offset of these planes is adjustable with seventeen degrees being found to be ideal. The applicator head pivots throughout a complete 360 degrees of slow rotation without any turning torque being generated due to the placement of a ball bearing at its point of connection. These applicator heads, which are exchangeable, based on desired size, shape or consistency, are constructed of a flexible material such as rubber, latex, plastic or fabric and form a flexible envelope. Small pellets, or some other suitable material, are loosely enclosed in the applicator head and provide a contour conforming quality to the head. The massage device generates direct circularly rotating pressure without risking inflicting lateral trauma to the tissue of the patient. The device is envisioned to be primarily used from a stationary support stand where the point of contact with the patient, and the amount of pressure applied, can be controlled and uniformly maintained although the device can be used as a hand held massage machine if desired.

U.S. Pat. No. 5,807,288

Inventor: Dong-Her Wu

Issues: Jun. 16, 1997

A pad type roller massager comprising an upper supporting bracket and a lower supporting brackets, an upper bracket cover and a lower bracket cover, a driving mechanism, a guiding column A, a sliding block, an eccentric motor, a positioning cover for motor, a position controller, a plurality of screws S, and a rollers assembly is provided. The upper and lower supporting brackets are connected by those pair of guiding column which are parallel with each other. A sliding block is moveably attached to the guiding columns and may move upward and downward along the guiding columns. The upper supporting bracket is enclosed with an upper bracket cover and the upper supporting bracket is rotationally disposed with a pulley therein. The lower supporting bracket is also enclosed with a lower bracket cover and the lower supporting bracket is disposed with a worm gear motor which in turn meshed with a worm gear having a pulley formed thereof. A belt is guided via the pulley and the worm gear having pulley. The free end of the belt is fixedly attached to the sliding block. Consequently, when the worm gear motor is rotated, the belt as well as the sliding block is moved upward and downward. The sliding block is further provided with a position controller which can reverse the rotating direction of the worm gear motor when the controller reach to the upper or lower supporting brackets. A plurality of rollers assemblies are carried by the sliding block and which may exert a massaging movement to the muscle when the rollers assemblies are moved along the guiding columns. The sliding block is further provided with an eccentric motor which provides vibration to the sliding block. As a result, the massager is featured with a three dimensional massaging movement.

U.S. Pat. No. 5,925,002

Inventor: Matt J. Wollman

Issues: Sep. 22, 1995

A hand-held massager includes an elongated handle, a contoured first massaging member or massaging head resiliently coupled to the handle, and at least one other massaging member or node mounted on the massaging head for providing an intense localized massage. The hand-held massager further includes a plurality of vibration inducing elements. A first vibration inducing element includes a main motor housed substantially within the handle is linked to a drive shaft extending from the motor into the massaging head. A massaging head eccentric cam is connected to the drive shaft within the massaging head for generally vibrating the massaging head and node relative to the handle upon rotation of the drive shaft. A second vibration inducing element includes a second motor or submotor linked to an output shaft. A second eccentric cam located substantially within the node extends from the output shaft for primarily vibrating the node upon rotation of the drive shaft. Other vibration inducing elements can be provided to vibrate additional vibratory members. Separate controls coupled to each vibration inducing element allow for independent control of each motor and the vibration induced in each massaging member. In operation, a user can adjust the relative phases of the motors to provide a wide variety of massage sensations.

U.S. Pat. No. 6,071,252

Inventor: Egidio Marcantoni

Issues: Sep. 28, 1998

A massaging device having a very simple structure, which can be used directly or can be inserted in the back of massage chairs or the like comprises a post which supports, so that it can slide in a substantially vertical direction, a movable framework provided with massage wheels. Elements are provided for the translatory motion of the framework along the post to move the massage wheels in substantially vertical directions to perform a massaging action of the so-called "stretching" type. The structural simplicity of the device allows to significantly contain its production costs.

While these massagers may be suitable for the purposes for which they were designed, they would not be as suitable for the purposes of the present invention, as hereinafter described.

SUMMARY OF THE PRESENT INVENTION

The present invention discloses a device that stimulates and provides chiropractic therapy to the neck and head area of the body. When in use the present invention allows for lateral and rotational movement of the head and neck muscles. Using a hand-held remote control, the doctor or patient utilizes a toggle stick to perform single directional movement of the head in a forward, backward, or side to side motion, or in a clockwise or counter clockwise rotational motion. The head cushion includes a vibration and heating element that is applied to the neck area that can be used in conjunction with the directional and rotational movement, or can be applied alone when the apparatus is stationary. The present invention cradles the head within a cushion that is adjustable vertically and laterally to optimize the positioning of the head and allow for comfort. The vibrating and heating element is isolated from the rest of the head cushion to eliminate transmission of vibrations or heat. The head cushion is supported by an adjustable tripod and controlled by an electric motor that provides motion to a spherical gudgeon and socket. In turn, the spherical gudgeon and socket allows for the lateral and rotational movement of the head cushion.

A primary object of the present invention is to provide therapeutic massage to the upper extremities and can be performed by one's self.

An additional object of the present invention is to provide safe physical therapy to injured or stressed upper extremities.

A further object of the present invention is to provide means to tone and strengthen the muscles of the neck and immediate area of which.

A yet further object of the present invention is to provide means to relieve the nerves of the neck and immediate area.

One more object of the present invention is to provide a massager that is simple and easy to use.

A further object of the present invention is to provide means to adjust to various head and body shapes to comfortably utilize the present invention.

A still further object of the present invention is to provide for hand held control of the movements of the apparatus by the doctor or patient during treatment.

One more object of the present invention is to provide a massager that is easy to store and transport.

Further objects of the present invention will appear as the description proceeds.

To the accomplishments of the above and related objects, this invention may be embodied in the form illustrated in the accompanying drawings, attention being called to the fact, however, that the drawings are illustrative only, and that changes may be made in the specific construction illustrated and described in the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

LIST OF REFERENCE NUMERALS

Figure 1:
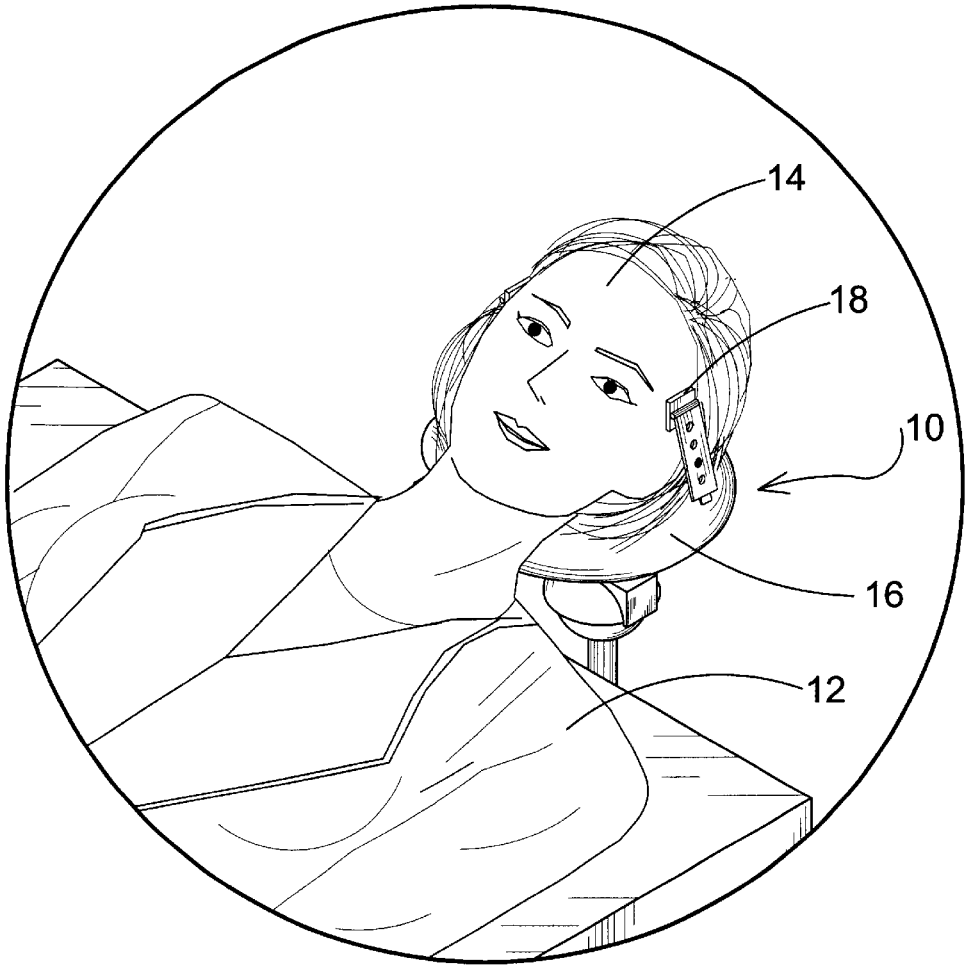
FIG. 1 is a perspective view of the present invention in use.

With regard to reference numerals used, the following numbering is used throughout the drawings.

10 present invention
12 patient
14 head of patient
16 head cushion
18 head pad
19 head pad support

20 height adjustment means
22 spring loaded hinge
24 height adjustment control button
26 neck pad
28 tripod bracket
30 tripod legs
32 adjustable stanchion
34 spherical gudgeon
36 spherical socket
38 head cushion connection member
39 neck rest connection member
40 tilt control motor housing
42 turn control motor housing
44 rotation control motor housing
46 rotation control motor
48 rotation control belt
50 tilt control motor
52 tilt control drive wheel
54 tilt control belt
56 interior head cushion housing
58 vibration/heating element
60 air gap
62 ceramic
64 toggle switch
66 handle
68 controller housing
70 arrow
72 turn control motor
74 turn control drive wheel
76 turn control belt
78 carrying case
80 carrying case strap
82 support brace

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is a perspective view of the present invention 10 in use by a patient 12. The user's head 14 is held against the head cushion 16 by the head pads 18 emanating therefrom.

Figure 2:
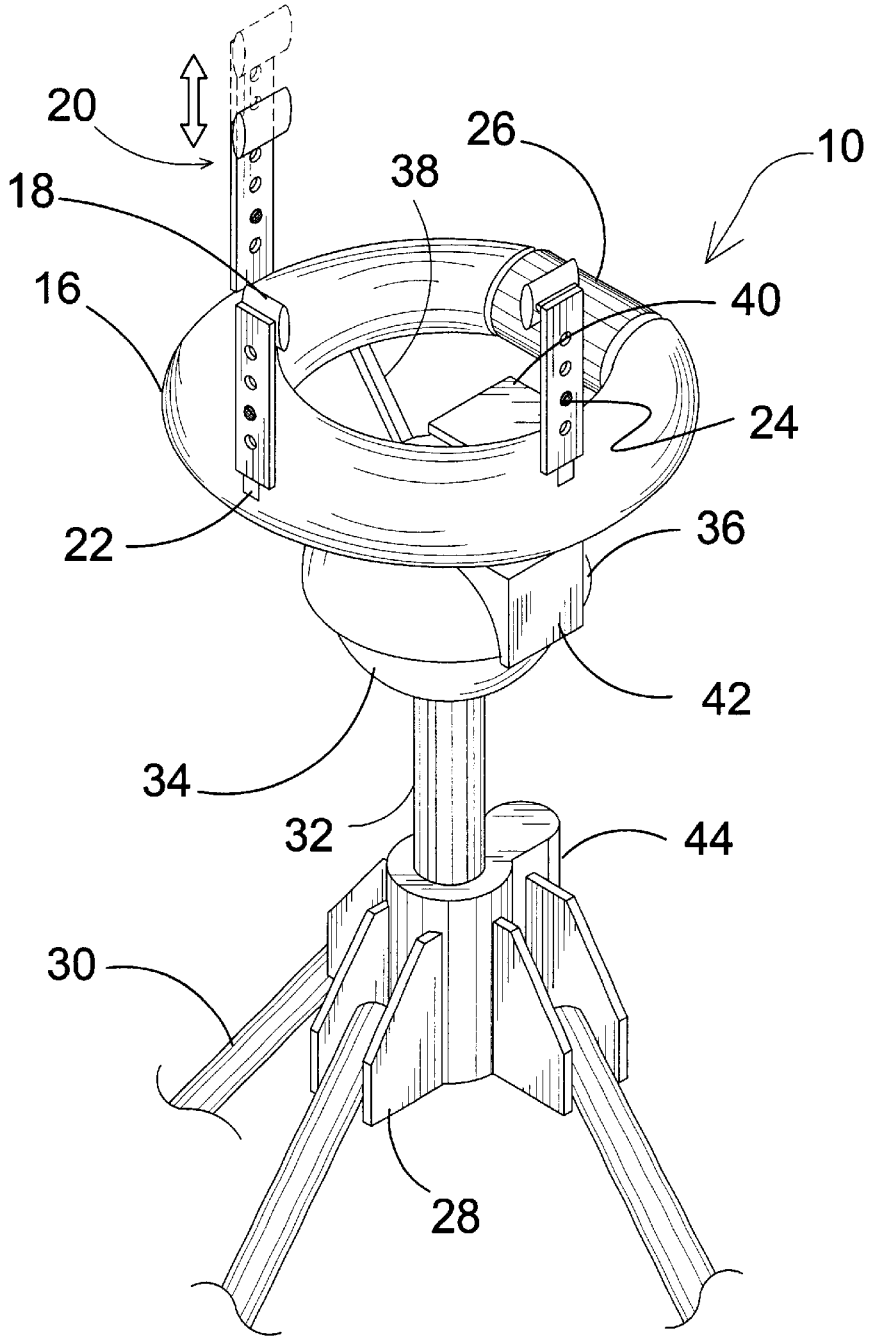
FIG. 2 is a perspective view of the present invention.

Turning to FIG. 2, shown therein is a perspective view of the present invention 10 having a head cushion 16 to hold the back of the head 14 of a patient with the addition of multiple head pads 18 to hold the sides and top of the user's head 14. The head pads 18 have height adjustment means 20 to ensure for proper fitting and comfort of the user's head 14. The head pads 18 have a spring loaded hinge 22 disposed on its base wherein the hinge 22 is attached to the head cushion 16. Also, the head pads 18 have a height adjustment control button 24 which allows the head pads 18 to be adjusted. A neck pad 26 is disposed on the head cushion 16 in the area to be adjacent to the neck of the patient. The head cushion has a tripod bracket 28 disposed on tripod legs being attached by stanchion 32 to a spherical gudgeon 34 which fits into spherical socket 36 which has means for attachment through connection members 38 to the underside of head cushion 16. Also shown are a tilt control motor housing 40, a turn control motor housing 42, and a rotation control motor housing 44.

Figure 3:
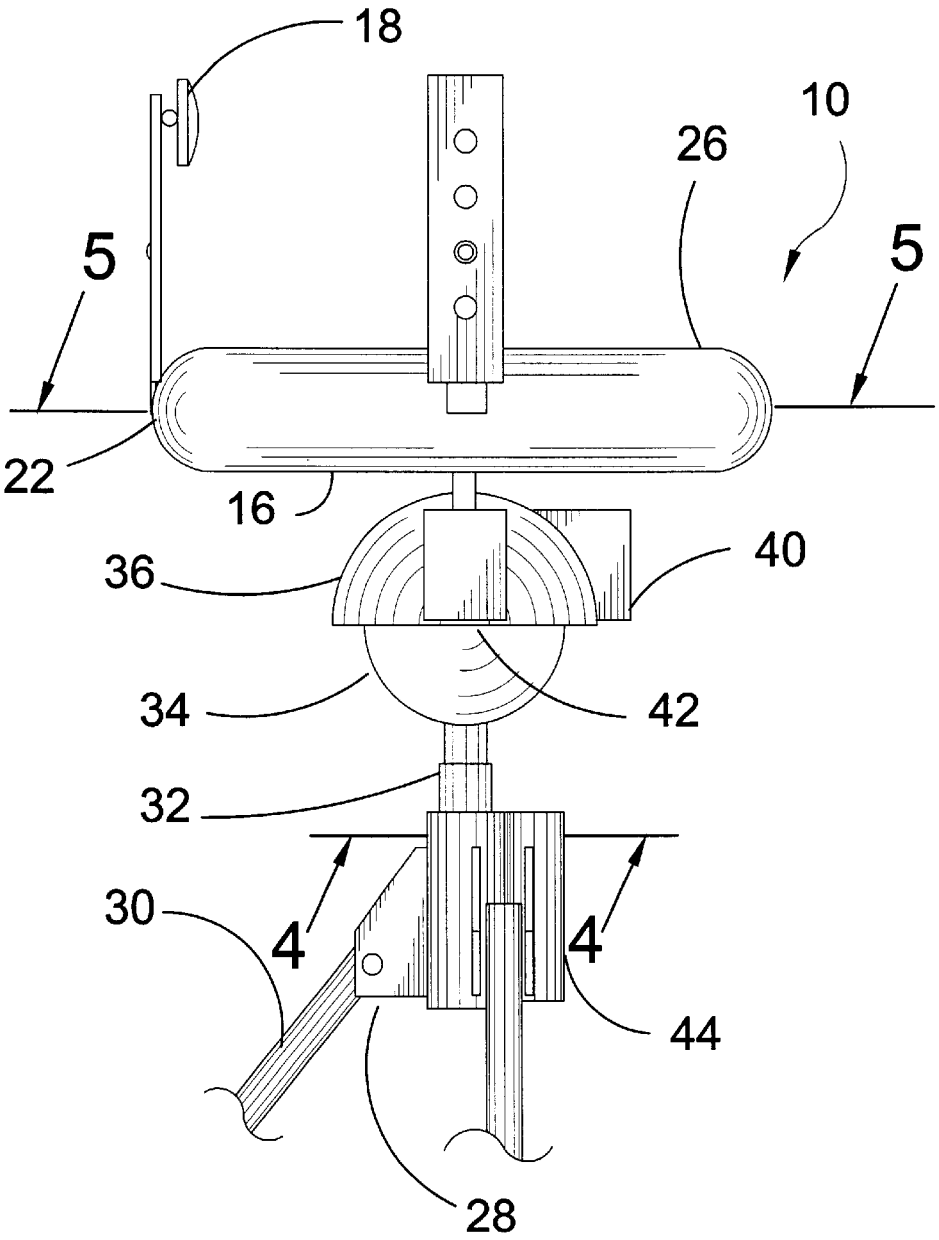
FIG. 3 is a side view of the present invention.

Turning to FIG. 3, shown therein is a side view of the present invention having a tripod bracket 28 disposed on the outer portion of the rotation control motor housing 44. Also shown is the head pad 18, the neck pad 26, the spring-loaded hinge 22, the head cushion 16, the spherical socket 36, spherical gudgeon 34, adjustable stanchion 32, tripod legs 30, the tilt control motor housing 40 and the turn control motor housing 42.

Figure 4:
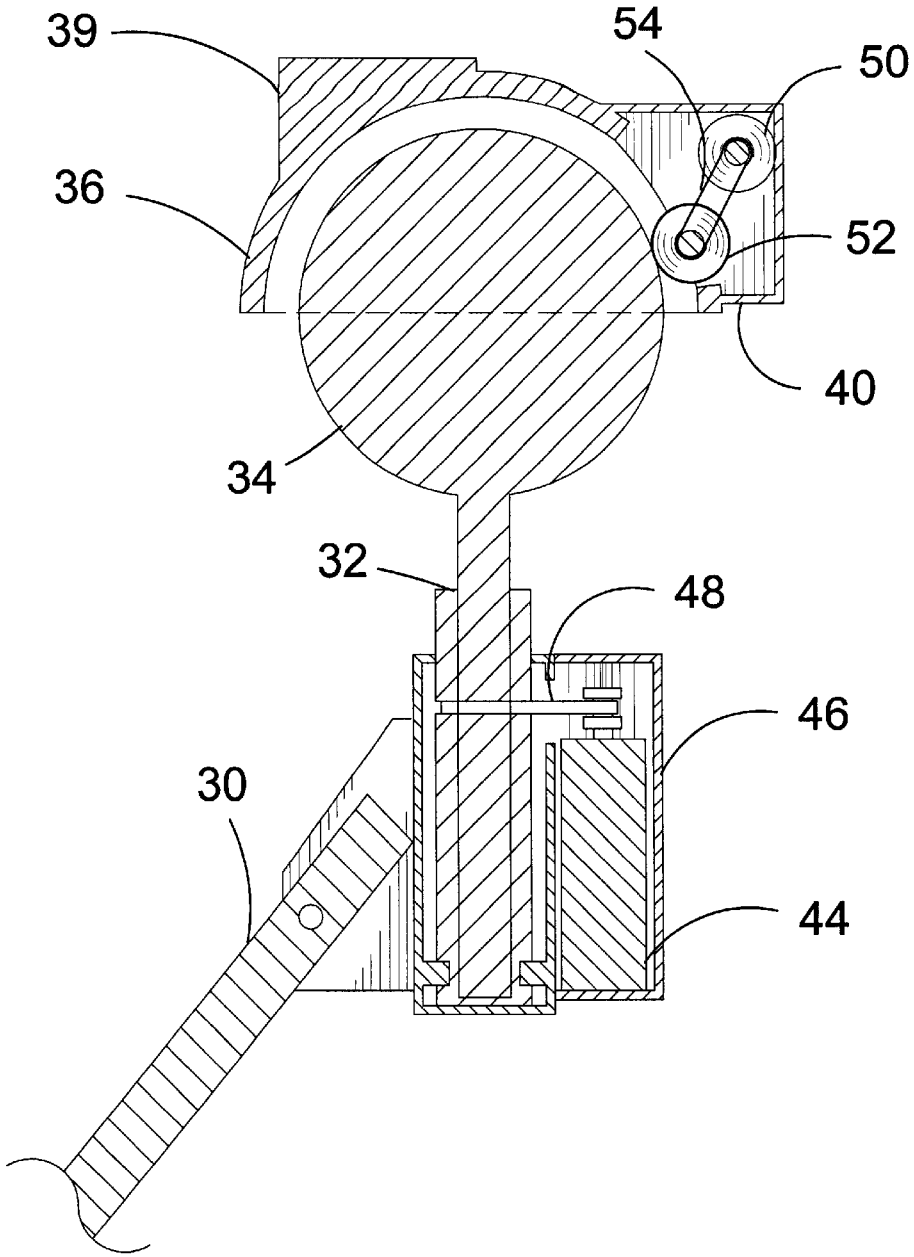
FIG. 4 is a cross sectional view of the present invention.

Turning to FIG. 4, shown therein is a cross sectional view of the present invention showing a spherical socket 36 wherein a spherical gudgeon 34 is inserted therein to form a connection that is capable of movement similar to a neck. Also shown are a plurality of motors and drive wheels to move the spherical socket 36 upon the spherical gudgeon 34 in multiple directions. Also shown is the neck pad connection member 39 which runs from the spherical socket 36 to the neck pad along with the adjustable stanchion 32, the tripod legs 30, and the rotation control motor housing 44, the rotation control motor 46, a belt 48 which runs from the rotation control motor drive gear to the base of the spherical gudgeon 34. Also shown is the tilt control motor housing 40 containing therein a tilt control motor 50 and a drive wheel 52 which contacts the spherical gudgeon 34 along with a belt drive unit 54.

Figure 5:
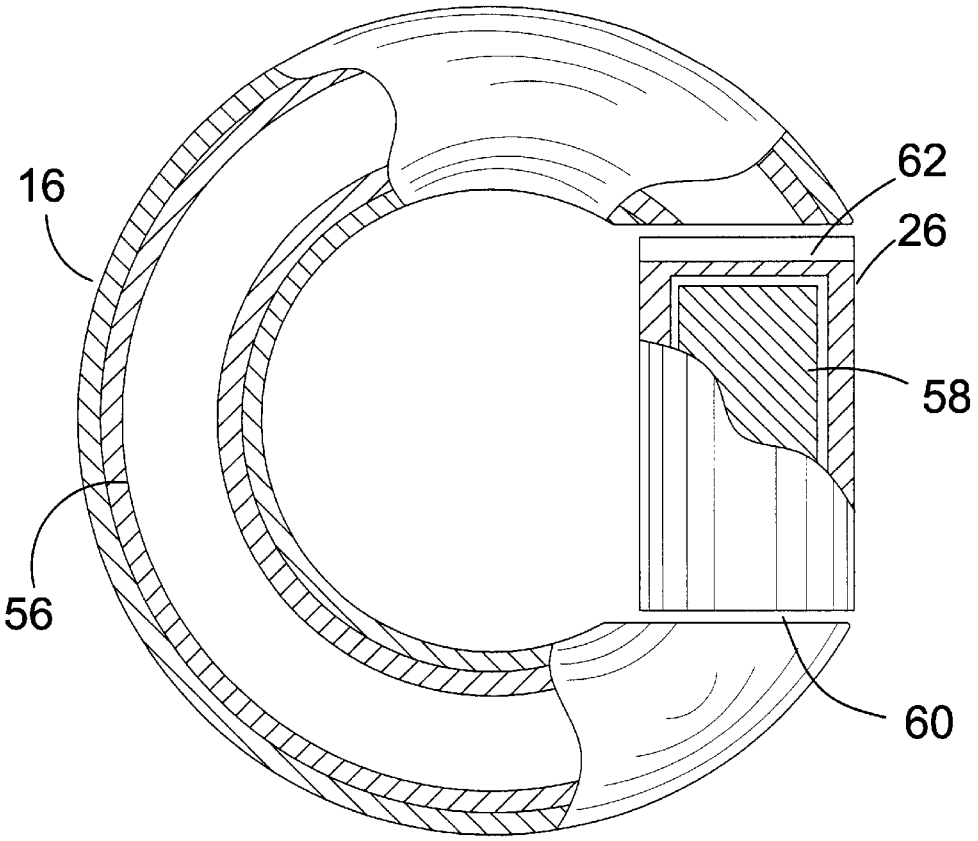
FIG. 5 is a cross sectional top view of the present invention.

Turning to FIG. 5, shown therein is a cross sectional top view of the present invention. The head cushion 16 of the present invention has a circular shape to better cradle the head of a user and an interior housing 56 with a heating and vibration element 58 only in the neck pad 26 with an air gap 60 on either end to eliminate vibration of the rest of the head cushion. Also shown is a ceramic portion 62 to help eliminate the transfer of heat to head cushion 16.

Figure 6:
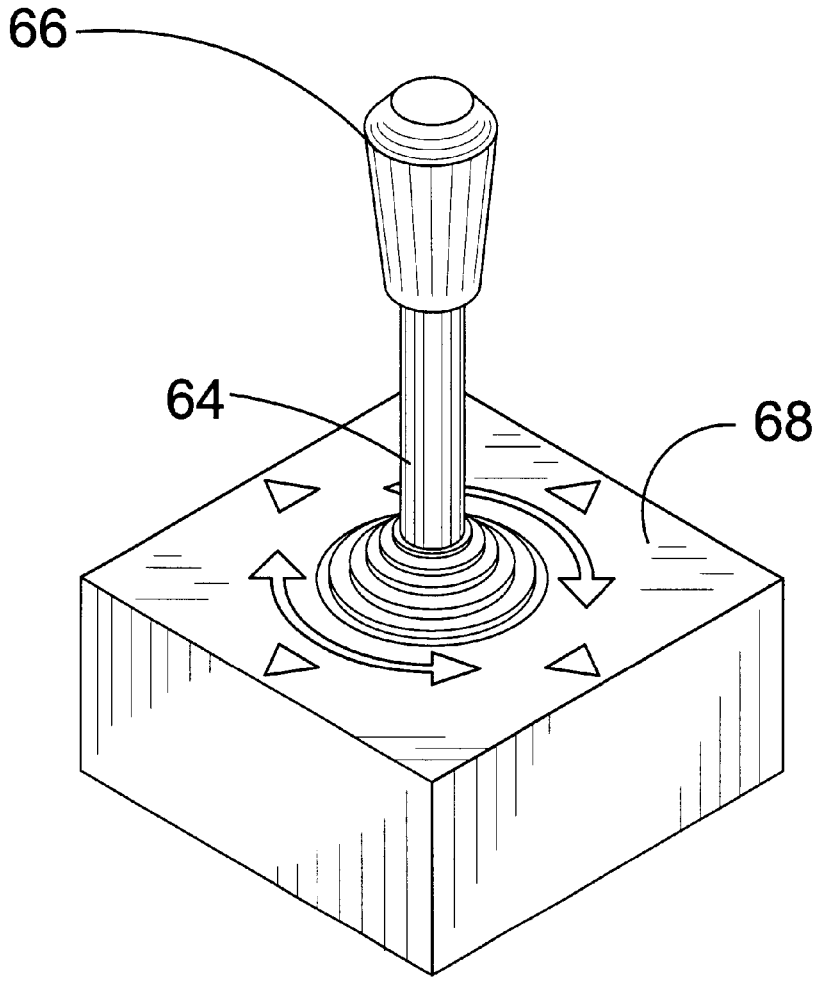
FIG. 6 is a perspective view of the controller.

Turning to FIG. 6, shown therein is a perspective view of the hand held controller of the present invention which controls the functions of the device utilizing a toggle stick 64 with handle 66. Single directional movement of the toggle stick for frontward, backward, side to side control and clockwise or counter clockwise circular movement for continuous rotational turning and tilting of the user's head. Also shown is the hand held controller housing 68.

Figure 7:
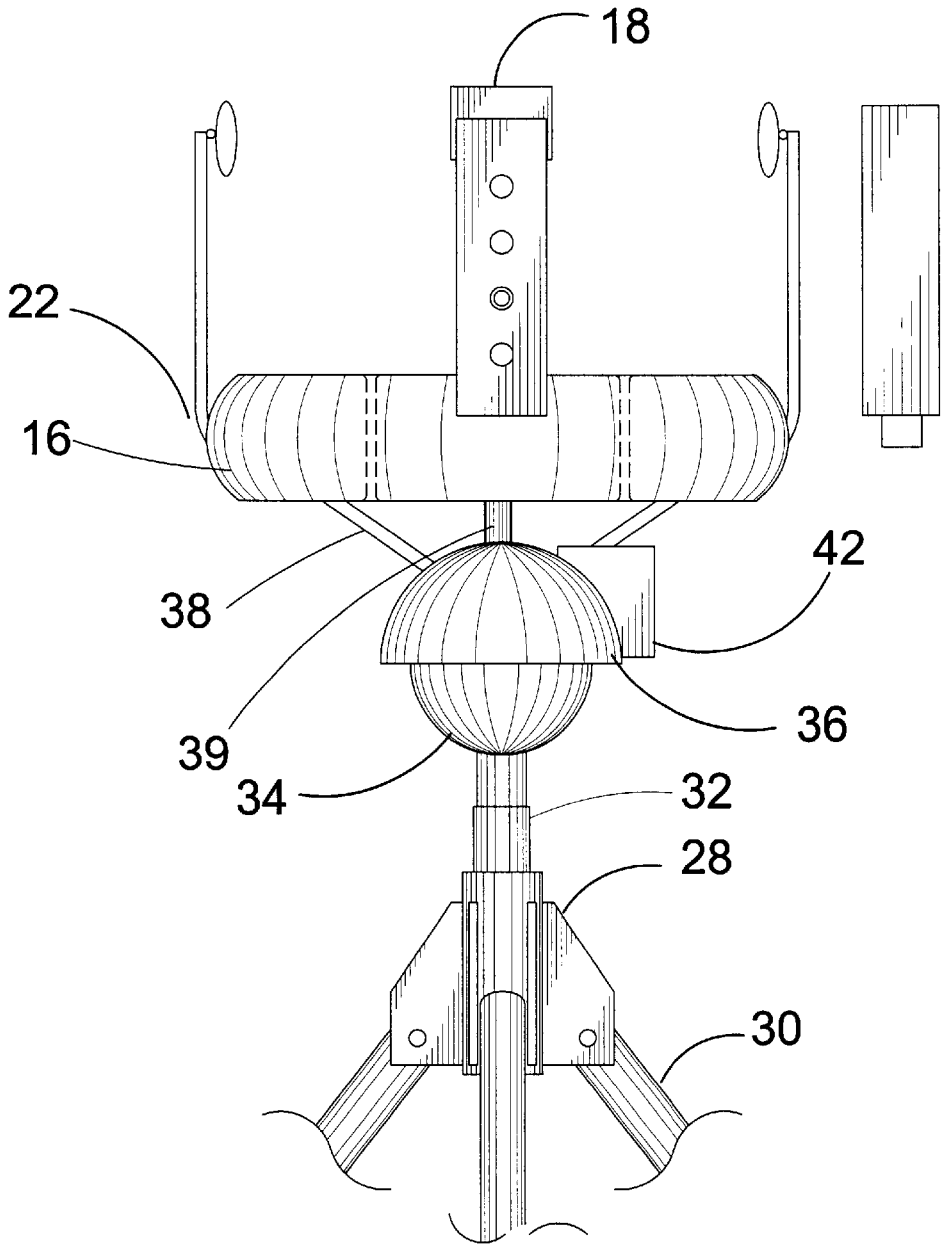
FIG. 7 is a front view of the present invention.

Turning to FIG. 7, shown therein is a front view of the present invention showing the present invention having an adjustable stanchion 32 to raise and lower the head cushion to a desired height. Also shown are the head pad 18, spring-loaded hinge 22, head cushion 16, head cushion connection member 38, neck rest connection member 39, spherical gudgeon 34, tripod legs 30, tripod bracket 28, spherical socket 36, and turn control motor housing 42.

Figure 8:
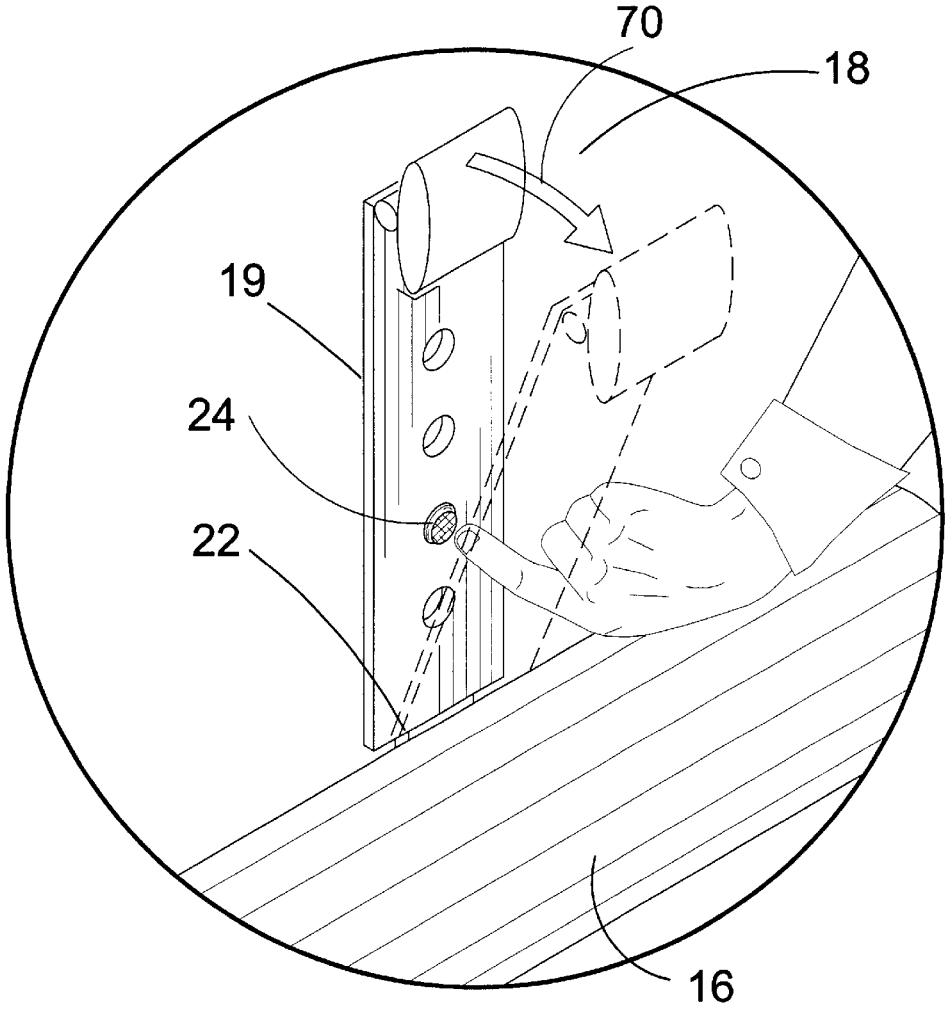
FIG. 8 is an enlarged view of a hinged head pad.

Turning to FIG. 8, shown therein is an enlarged view of a hinged head pad 18. Shown are the head pads 18 with spring loaded hinges 22 where the head pads 18 support 19 meets the head cushion 16. Also shown is an arrow 70 to indicate how the spring loaded hinges 22 help the head pads 18 to grip the user's head. As mentioned in FIG. 2, there is an additional vertical adjustment 24 for proper fitting of the user's head. In operation one depresses the button 24 and slides the support 19 to the desired height where it is released and locked in a slot.

Figure 9:
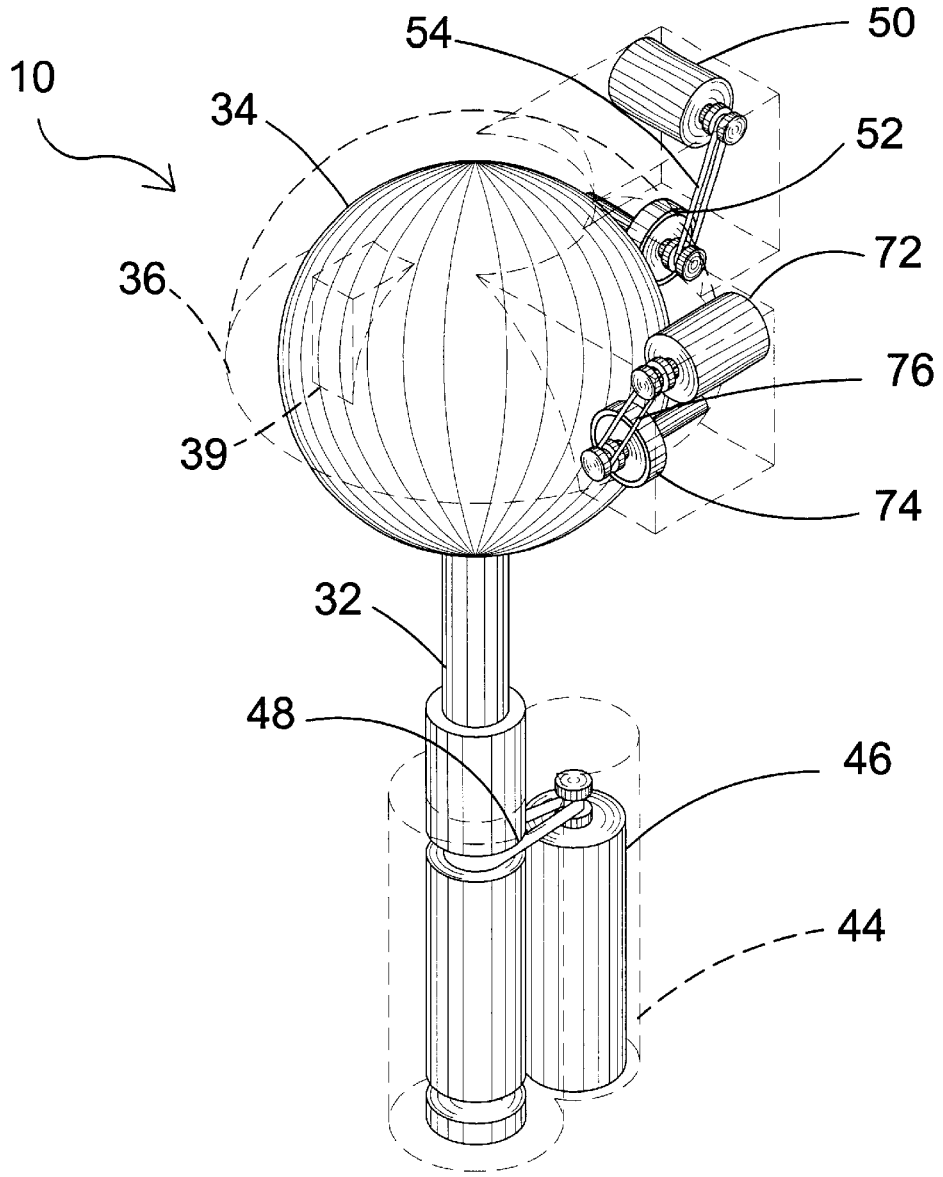
FIG. 9 is a perspective view of the present invention.

Turning to FIG. 9, shown therein is a perspective view of the present invention 10 showing the present invention having a plurality of motors attached to drive wheels by belts that control the tilting and turning functions of the device by producing radial movement of the spherical socket 36 about the spherical gudgeon 34. Also shown is a rotation control motor 46 to turn the adjustable stanchion 32 to produce the devices rotational function. Also shown are the rotation control motor housing 44 and belt 48 along with the neck pad connection member 39. Additionally, there is shown the tilt control motor 50 and the tilt control drive wheel 52, along with its corresponding belt 54. Also shown are the turn control motor 72, the turn control drive wheel 74 with its associated drive belt 76.

Figure 10:
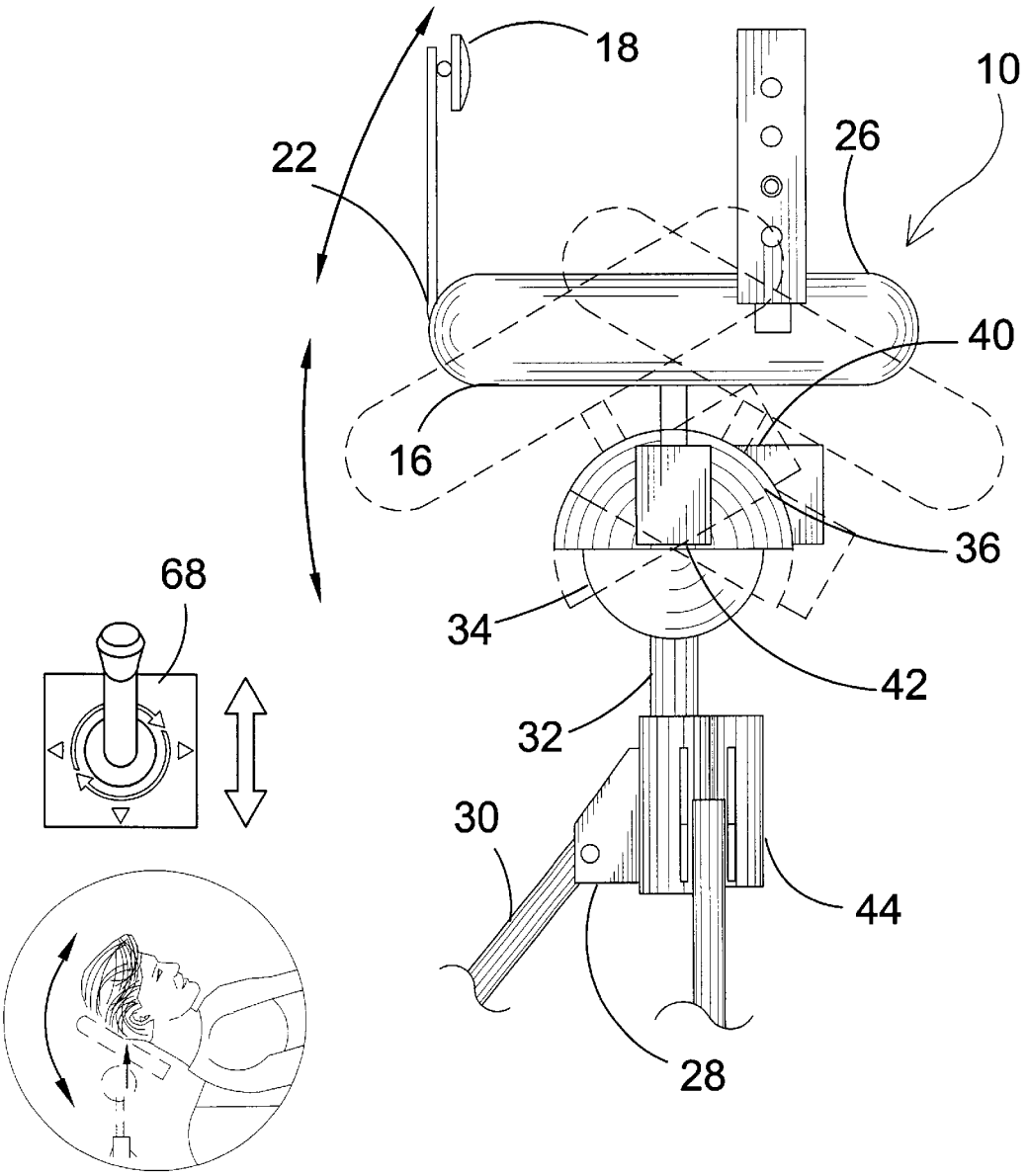
FIG. 10 is a side view of the present invention.

Turning to FIG. 10, shown therein is a side view of the present invention 10 showing the present invention performing the tilting function by moving the spherical socket 36 forward and backward on the spherical gudgeon 34 via usage of the tilt control motor housing 40 and motor and its associated components. This function produces backward and forward movement of the user's head. Other elements previously disclosed are also shown.

Figure 11:
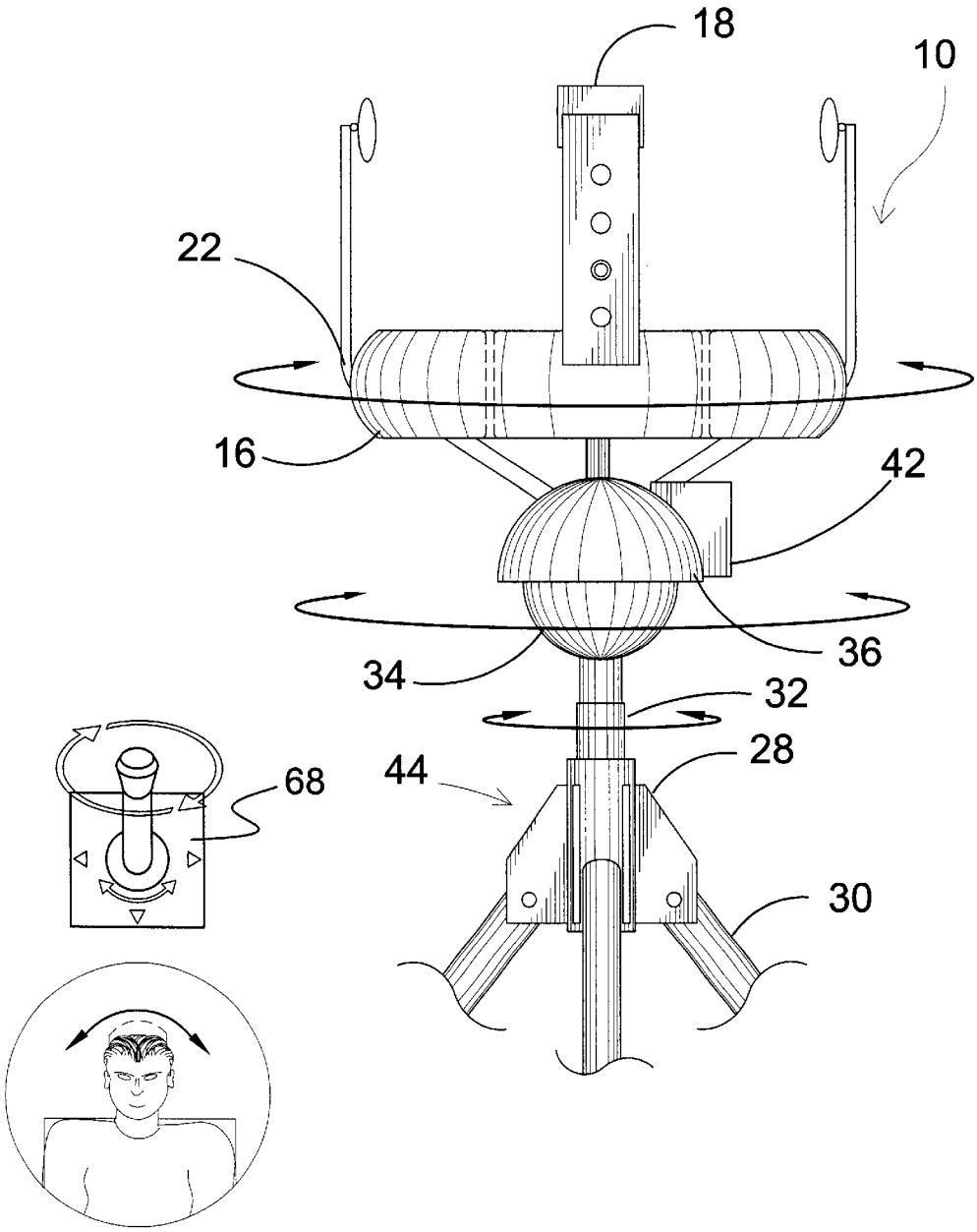
FIG. 11 is a front view of the present invention.

Turning to FIG. 11, shown therein is a front view of the present invention 10 showing the present invention performing the rotation function of the device via usage of the rotation control motor housing 44 and motor to rotate the adjustable stanchion 32 side to side. This function causes the user's head to rotate in small to large circles in both directions. Other elements previously disclosed are also shown.

Figure 12:
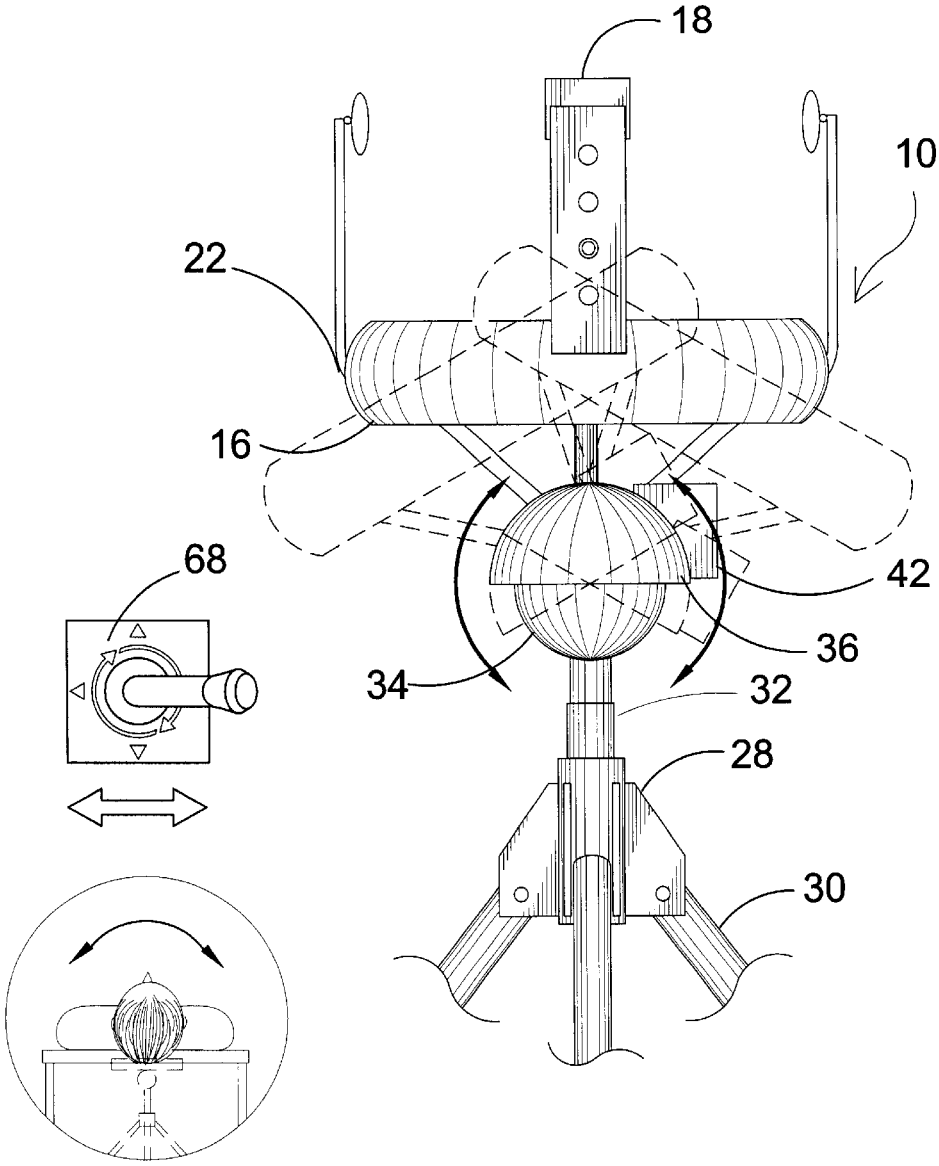
FIG. 12 is a front view of the present invention.

Turning to FIG. 12, shown therein is a front view of the present invention 10 showing the present invention performing the turning function of the device via usage of the turn control motor housing 42 and motor acting upon the spherical gudgeon 34 to move the spherical socket 36 about the spherical gudgeon 34 in a side to side motion. This function causes the user's head to turn side to side. Other elements previously disclosed are also shown.

Figure 13:
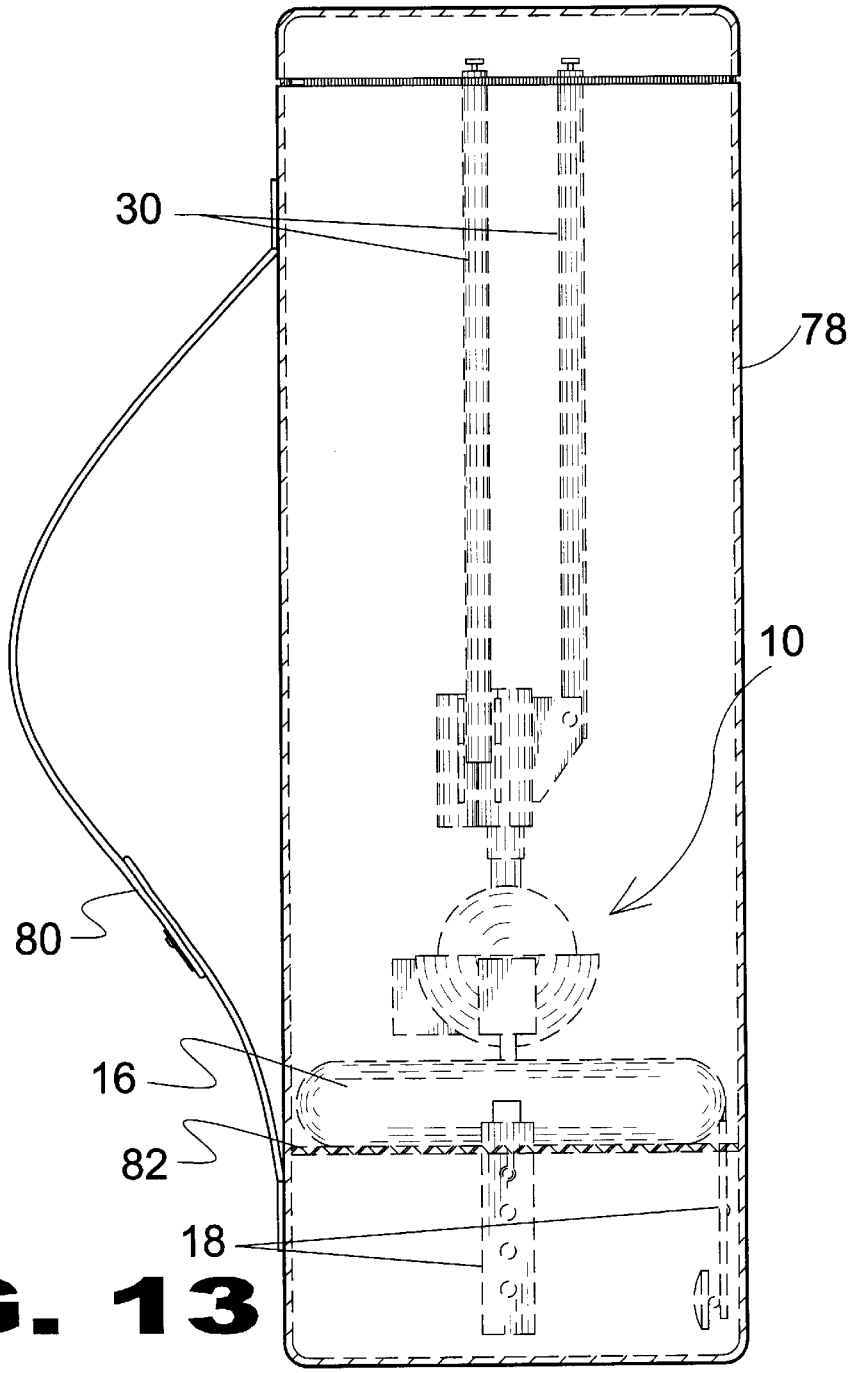
FIG. 13 is a side view of the present invention.

Turning to FIG. 13, shown therein is a side view of the present invention 10. The present invention 10 includes a protective carrying case 78 for portability. The chiropractic device is prepared for transport by retracting the tripod legs 30 and adjusting the head pad 18 height settings to the lowest position. The chiropractic device is inserted into the carrying case 78 head pad first. The protective carrying case 78 includes an internal support brace 82 that allows the head pads 18 to pass through the brace and rest without encumbrance in the lower end of the case, thus allowing the weight of the chiropractic device to rest on the head cushion 16. An external shoulder strap 80 is provided for lifting and carrying the case 78.

What is claimed to be new and desired to be protected by Letters Patent is set forth in the appended claims:

1. An apparatus that provides movement to the head and neck muscles of a patient user, comprising:

a) an upright standing support stanchion having a first end and a second end, said stanchion having a plurality of legs disposed on said second end;

b) a spherical gudgeon disposed on said first end of said stanchion for insertion into a spherical socket;

c) a spherical socket disposed on said gudgeon to permit movement of the socket about the gudgeon;

d) a circular head cushion disposed on said spherical socket, said head cushion for receiving the back portion of the head of a patient;

e) a neck pad disposed in said head cushion for being adjacent to the neck of a patient;

f) a plurality of elongated connection members to permit the head cushion and neck pad to be connected to the spherical socket;

g) means for rotating the support stanchion, whereby the head cushion is rotated clockwise or counterclockwise;

h) means for turning the spherical socket whereby the head cushion is turned in a side-to-side direction;

i) means for tilting the spherical socket whereby the head cushion is moved in a forward to backward direction; and, j) means for controlling said means for rotating the support stanchion, said means for turning the spherical socket, and said means for tilting the spherical socket.

2. The apparatus of claim 1, wherein said second end of said support stanchion further comprises a tripod bracket disposed thereon, said tripod bracket having said plurality of legs attached thereto, said tripod bracket having a rotation control motor housing disposed thereon to permit rotation of the support stanchion.

3. The apparatus of claim 2, wherein said support stanchion further comprises at least a pair of telescoping members to permit adjustment of the height of the support stanchion.

4. The apparatus of claim 3, wherein said circular head cushion further comprises a plurality of head pads disposed thereon to permit the head of the patient to be held therein said plurality of head pads.

5. The apparatus of claim 4, wherein said head pads further comprise an elongated support member, said support member having a spring-loaded hinge on one end for connection of said support member to said head cushion to permit lateral movement of said head pad.

6. The apparatus of claim 5, wherein said head pad further comprises height adjustment control buttons disposed on said support member to permit the height of said head pad to be varied.

7. The apparatus of claim 6, wherein said head cushion further comprises an interior head cushion housing disposed therein to provide support for the head cushion.

8. The apparatus of claim 7, wherein said interior head cushion housing further comprises a vibration/heating element disposed adjacent said neck pad to permit the neck of the patient to be heated and vibrated.

9. The apparatus of claim 8, wherein said vibration/heating element is insulated from said head cushion to permit the head cushion to be substantially free of vibration and heat.

10. The apparatus of claim 9, wherein said vibration/heating element has its ends spaced away from said head cushion to permit an air gap to exist between said vibration/heating element and said head cushion, further said vibration/heating element comprises a ceramic element on its ends to permit heat to be insulated from said head cushion.

11. The apparatus of claim 10, wherein said means for rotating the support stanchion comprises:

a) a rotation control motor housing disposed on said tripod bracket;

b) a rotation control motor disposed internal said rotation control motor housing to permit the support stanchion to turn, said motor having a drive shaft thereon;

c) a rotation control belt connecting said drive shaft of said rotation control motor and said support stanchion to permit the rotation control motor to turn the support stanchion; and, d) a rotation control motor controller for electronic communication with a handheld controller.

12. The apparatus of claim 11, wherein said means for turning the spherical socket comprises:

a) a turning control motor housing disposed on said spherical socket;

b) a turning control motor disposed internal said turning control motor housing to permit the spherical socket to turn, said motor having a drive shaft thereon;

c) a turning control drive wheel disposed internal said turning control motor housing, said drive wheel contacting said spherical gudgeon to permit the spherical socket to turn about the spherical gudgeon;

d) a turning control belt connecting said drive shaft of said turning control motor and said turning control drive wheel to permit the turning control motor to turn the spherical socket; and, e) a turning control motor controller for electronic communication with a handheld controller.

13. The apparatus of claim 12, wherein said means for tilting the spherical socket comprises:

a) a tilting control motor housing disposed on said spherical socket;

b) a tilting control motor disposed internal said tilting control motor housing to permit the spherical socket to turn, said motor having a drive shaft thereon;

c) a tilting control drive wheel disposed internal said tilting control motor housing, said drive wheel contacting said spherical gudgeon to permit the spherical socket to turn about the spherical gudgeon;

d) a tilting control belt connecting said drive shaft of said tilting control motor and said tilting control drive wheel; and, e) a tilting control motor controller for electronic communication wit a handheld controller.

14. The apparatus of claim 13, wherein said means for controlling said means for rotating the support stanchion, said means for turning the spherical socket, and said means for tilting the spherical socket further comprises a handheld controller, said handheld controller further comprising a housing, said handheld controller further comprising a toggle stick to permit control of the apparatus, and a handle disposed on said toggle stick for use by a user.

15. The apparatus of claim 14, further comprising a carrying case for the apparatus, said carrying case having a support strap thereon for use by a user.

16. The apparatus of claim 15, wherein said carrying case further comprises a support brace disposed internal therein, said support brace for receiving said head cushion, said support brace having multiple openings therein, said openings for allowing said head pads to pass therethrough to permit said head cushion to rest on said support brace.

* * * * *